US011918064B2

(12) United States Patent
Andrews et al.

(10) Patent No.: US 11,918,064 B2
(45) **Date of Patent: *Mar. 5, 2024**

(54) PROTECTIVE GLOVE WITH ENHANCED EXTERIOR SECTIONS

(71) Applicant: World Fibers, Inc., Concord, NC (US)

(72) Inventors: Gregory V. Andrews, Concord, NC (US); Rayvon A. Morton, Oakboro, NC (US); Paul W. Cornelison, Salisbury, NC (US); John D. Simmons, Rockwell, NC (US)

(73) Assignee: World Fibers, Inc., Concord, NC (US)

( * ) Notice: Subject to any disclaimer, the term of this patent is extended or adjusted under 35 U.S.C. 154(b) by 203 days.

This patent is subject to a terminal disclaimer.

(21) Appl. No.: 17/203,959

(22) Filed: Mar. 17, 2021

(65) Prior Publication Data

US 2021/0195971 A1 Jul. 1, 2021

Related U.S. Application Data

(63) Continuation of application No. 14/657,081, filed on Mar. 13, 2015, now abandoned, which is a continuation-in-part of application No. 14/296,612, filed on Jun. 5, 2014, now Pat. No. 9,877,529, which is a continuation-in-part of application No.

(Continued)

(51) Int. Cl.

| | |
|---|---|
| ***A41D 19/015*** | (2006.01) |
| ***A41D 19/00*** | (2006.01) |
| ***D02G 3/44*** | (2006.01) |

(52) U.S. Cl.

CPC ... *A41D 19/01547* (2013.01); *A41D 19/0006* (2013.01); *A41D 19/01511* (2013.01); *D02G 3/442* (2013.01); *A41D 2500/10* (2013.01)

(58) Field of Classification Search

CPC ..... D02G 3/442; A41D 19/01505

See application file for complete search history.

(56) References Cited

U.S. PATENT DOCUMENTS 4,146,935 A * 4/1979 Hinton ..... A41D 19/01576 2/161.3

4,384,449 A * 5/1983 Byrnes, Sr. ..... D02G 3/442 57/902

(Continued)

FOREIGN PATENT DOCUMENTS

JP 04-064516 A 2/1992

WO WO2007024872 A2 3/2007

OTHER PUBLICATIONS

Japanese Patent Office, English translation of abstract of JP 04-064516, published Feb. 28, 1992.

*Primary Examiner* — Alissa L Hoey

(74) *Attorney, Agent, or Firm* — ASHLEY LAW FIRM P.C.; Stephen S. Ashley, Jr.

(57) ABSTRACT

A protective glove includes a primary yarn that forms the palm, thumb and finger sections of the glove. The primary yarn has an interior surface forming the interior surface of the glove, and an exterior surface forming the exterior surface of the glove. A plaiting yarn can be plaited to portions of the exterior surface of the primary yarn to form a plurality of enhanced sections on the exterior surface of the glove. The enhanced sections can have at least one substantially enhanced physical characteristic in relation to the primary layer.

7 Claims, 14 Drawing Sheets

Related U.S. Application Data

14/210,533, filed on Mar. 14, 2014, now Pat. No. 10,130,128.

(60) Provisional application No. 61/789,990, filed on Mar. 15, 2013.

(56) References Cited

U.S. PATENT DOCUMENTS 4,470,251 A * 9/1984 Bettcher ..... D02G 3/442 57/902
4,651,514 A * 3/1987 Collett ..... D02G 3/36 57/902
4,777,789 A * 10/1988 Kolmes ..... D02G 3/448 57/902
4,825,470 A * 5/1989 Horio ..... A41D 13/087 2/163
4,838,017 A * 6/1989 Kolmes ..... D02G 3/442 57/902
4,912,781 A * 4/1990 Robins ..... A41D 19/01511 57/200
4,942,626 A * 7/1990 Stern ..... A61B 42/00 2/21
5,119,512 A * 6/1992 Dunbar ..... D02G 3/38 442/310
5,231,700 A * 8/1993 Cutshall ..... A61B 42/10 2/167
5,248,548 A * 9/1993 Toon ..... A41D 31/26 428/377
5,319,950 A * 6/1994 Whitt ..... A41D 31/24 66/182
5,321,960 A * 6/1994 Whitt ..... D04B 1/26 57/236
5,442,815 A * 8/1995 Cordova ..... A41D 19/01505 428/377
5,597,649 A * 1/1997 Sandor ..... D02G 3/442 428/370
5,628,172 A * 5/1997 Kolmes ..... D04B 1/28 2/167
5,745,919 A * 5/1998 Kraatz ..... A41D 19/01505 2/163
5,918,319 A * 7/1999 Baxter ..... A41D 13/0593 2/22
5,965,223 A 10/1999 Andrews et al.
6,033,779 A 3/2000 Andrews
6,155,084 A 12/2000 Andrews et al.
6,161,400 A * 12/2000 Hummel ..... A41D 19/01505 66/174
6,216,431 B1 4/2001 Andrews
6,279,305 B1 * 8/2001 Hummel ..... D02G 3/38 57/210
6,351,932 B1 * 3/2002 Hummel ..... D02G 3/385 57/210
6,363,703 B1 * 4/2002 Kolmes ..... A41D 19/01505 57/220
6,413,636 B1 * 7/2002 Andrews ..... D02G 3/38 428/401
6,467,251 B1 * 10/2002 Kolmes ..... D02G 3/442 57/210
6,534,175 B1 * 3/2003 Zhu ..... D02G 3/442 442/310
6,581,366 B1 6/2003 Andrews
6,766,635 B2 7/2004 Andrews
6,779,330 B1 8/2004 Andrews et al.
6,782,720 B2 8/2004 Vero et al.
6,803,332 B2 10/2004 Andrews
7,100,352 B2 * 9/2006 Robins ..... D02G 3/448 57/210
7,121,077 B2 10/2006 Andrews et al.
7,178,323 B2 * 2/2007 Kolmes ..... D02G 3/12 57/210
7,434,422 B2 10/2008 Thompson et al.
7,555,921 B2 7/2009 Thompson et al.
7,669,442 B1 * 3/2010 Zhu ..... D02G 3/328 66/174
7,934,395 B2 * 5/2011 Zhu ..... D02G 3/442 66/174
8,074,436 B2 12/2011 Hardee et al.
8,302,374 B2 11/2012 Marissen et al.
9,587,333 B1 * 3/2017 Ellsworth ..... A41D 19/01547
9,788,585 B2 * 10/2017 Thompson ..... A41D 19/015
9,877,529 B2 * 1/2018 Andrews ..... A41D 19/0006
9,994,979 B2 * 6/2018 Kolmes ..... A41D 31/24
10,130,128 B2 * 11/2018 Andrews ..... D04B 1/28
10,292,440 B2 * 5/2019 Fernando ..... D04B 1/28
10,349,690 B2 * 7/2019 Francisco Costa ..... A41D 19/0065
10,520,280 B2 * 12/2019 Schulein ..... D04B 1/246
10,995,432 B2 * 5/2021 Mathota ..... A41D 19/01576
11,131,042 B1 * 9/2021 Kim ..... D04B 1/28
11,208,744 B2 * 12/2021 Urbelis ..... A41D 31/245
11,639,567 B2 5/2023 Lawrence
2004/0011087 A1 * 1/2004 Rebouillat ..... D04B 1/14 66/174
2008/0289312 A1 * 11/2008 Takada ..... A41D 19/01511 57/232
2010/0050699 A1 * 3/2010 Kolmes ..... D04B 1/28 66/178 R
2010/0186144 A1 * 7/2010 Zhu ..... D02G 3/185 2/167
2010/0186457 A1 * 7/2010 Zhu ..... D02G 3/185 2/168
2010/0275341 A1 11/2010 Sweeney et al.
2010/0275342 A1 11/2010 Sweeney et al.
2012/0204604 A1 8/2012 Azeem et al.
2013/0000005 A1 * 1/2013 Hughes ..... A41D 19/01505 2/16
2013/0205469 A1 8/2013 Thompson et al.
2013/0213094 A1 8/2013 Moreland et al.
2014/0090349 A1 * 4/2014 Fisher ..... D02G 3/367 57/227
2015/0220146 A1 * 8/2015 Fisher ..... D02G 3/442 2/167
2016/0073713 A1 * 3/2016 Takata ..... D02G 3/442 2/167
2019/0059476 A1 * 2/2019 Taylor ..... D02G 3/12
2019/0166932 A1 * 6/2019 Taylor ..... D02G 3/36
2020/0399798 A1 * 12/2020 O'Sullivan ..... D04B 1/243
2023/0301374 A1 9/2023 Hull

* cited by examiner

PROTECTIVE GLOVE WITH ENHANCED EXTERIOR SECTIONS

CROSS REFERENCE TO RELATED APPLICATIONS

This application is a continuation of U.S. patent application Ser. No. 14/657,081 filed Mar. 13, 2015, which is a continuation-in-part of U.S. patent application Ser. No. 14/296,612, filed Jun. 5, 2014, now U.S. Pat. No. 9,877,529, which is a continuation-in-part of U.S. patent application Ser. No. 14/210,533, filed Mar. 14, 2014, now U.S. Pat. No. 10,130,128, which claims priority to U.S. Provisional Patent Application No. 61/789,990, filed Mar. 15, 2013. All of said applications are incorporated herein by reference.

TECHNICAL FIELD

The present invention relates to fabric articles, such as gloves with sections having enhanced properties formed on the exterior surface of the glove. An embodiment of the invention comprises a glove having enhanced sections on portions of the exterior surface of the glove. The enhanced sections can have superior physical properties, such as cut or abrasion resistance, in relation to the other parts of the glove.

BACKGROUND

Often it is desirable for a single glove to be constructed of various sections having distinct properties. For example, safety gloves often have an interior surface layer comprised of a relatively soft yarn for the comfort of the wearer, and an exterior surface comprised of a relatively rough yarn providing cut resistance. Plaiting (also known as "plating") is a process that has been used to make such gloves. Plaiting is a process in which the fabric is produced from two yarns having different properties or characteristics. A primary yarn is placed on the outside (or face) of the fabric, and the plaiting yarn is placed on the inside (or back) of the fabric.

Prior art gloves constructed of plaited fabrics have required the yarn with enhanced properties to be plaited to the inside (back) of the fabric. When it is desirable because of cosmetic or functional requirements for the plaiting yarn to be on the outside of the glove, the glove must be inverted (turned inside out). Inverting is a separate, time-consuming operation done manually or on a special machine.

SUMMARY

Therefore, one object of the present invention is to provide a glove comprising a plaited fabric, in which the plaiting yarn is plaited to the exterior surface of the fabric. Another object of the present invention is to provide a fabric article, such as a glove, comprising sections having enhanced properties formed on the exterior surface of the glove. The enhanced sections can be areas on the exterior surface of the glove having superior physical properties, such as cut or abrasion resistance, in relation to the other parts of the glove. These and other objects of the invention can be obtained in various embodiments of the invention described below.

One embodiment of the invention comprises a protective glove comprising a primary yarn used to construct a palm section, and thumb, index finger, middle finger, ring finger and baby finger sections. The interior surface of the primary yarn defines the interior surface of the glove, and the exterior surface of the primary yarn defines the exterior surface of the glove. Enhanced sections are formed on the exterior surface of the glove, and the enhanced sections have at least one substantially enhanced physical characteristic in relation to the primary yarn.

According to another embodiment of the invention, the enhanced sections are formed by a secondary yarn plaited to portions of the exterior surface of the primary yarn.

According to another embodiment of the invention, the enhanced sections provide enhanced cut resistance, and the secondary yarn comprises at least one material selected from the group consisting of ultra-high molecular weight polyethylene and a hard particle-filled polyethylene fiber wherein the hard particles have a MOHS hardness of greater than three.

According to another embodiment of the invention, the enhanced sections are formed on portions of the index finger section, the middle finger section, the ring finger section and the baby finger section.

According to another embodiment of the invention, the enhanced sections are formed on the palm section, the thumb section, the index finger section, and the middle finger section.

According to another embodiment of the invention, the primary yarn comprises a core comprising a first strand of fiberglass and a second strand of ultra-high molecular weight polyethylene, and at least one cover strand wrapped around the core.

According to another embodiment of the invention, a first cover strand of textured polyester is wrapped around the core, and a second cover strand of textured polyester is wrapped around the core and the first strand of textured polyester.

According to another embodiment of the invention, the enhanced sections provide enhanced resistance to abrasion, and the secondary yarn comprises a strand of flat nylon.

According to another embodiment of the invention, the primary yarn comprises a core comprised of a first strand of fiberglass and a second strand of ultra-high molecular weight polyethylene, and at least one cover strand comprising textured polyester wrapped around the core.

According to another embodiment of the invention, the enhanced sections provide enhanced gripping properties, and the secondary yarn is comprised of latex rubber, spandex, and/or micro-fiber polyester.

According to another embodiment of the invention, the primary yarn comprises a core comprising a first core strand comprised of fiberglass and/or flat polyester, and a second core strand comprised of ultra-high molecular weight polyethylene and/or stainless steel wire.

According to another embodiment of the invention, a first cover strand comprised of textured polyester and/or stainless steel wire is wrapped around the core, and a second cover strand comprised of textured polyester is wrapped around the first cover strand and the core.

According to another embodiment of the invention, the enhanced sections are substantially rectangular and extend laterally across the palm section, the thumb section, and the finger sections of the glove.

According to another embodiment of the invention, the secondary yarn comprises a retroreflective material, so that the enhanced sections provide enhanced visibility of the glove.

According to another embodiment of the invention, the primary yarn comprises a core comprising a first strand of fiberglass and a second strand of ultra-high molecular weight polyethylene, and at least one cover strand comprising textured polyester wrapped around the core.

According to another embodiment of the invention, the secondary yarn comprises an electrically conductive material, so that a wearer of the glove can operate a touch screen on an electronic device by contacting the touch screen with the enhanced sections.

According to another embodiment of the invention, the primary yarn comprises a core comprising a first core strand comprising fiberglass, and a second core strand comprising ultra-high molecular weight polyethylene. A first cover strand comprising textured nylon is wrapped around the core, and a second cover strand comprising textured nylon is wrapped around the first cover strand and the core.

According to another embodiment of the invention, the enhanced sections are located at the tips of the thumb section, index finger section and middle finger section.

A protective glove according to another embodiment of the invention comprises a primary yarn defining a palm section, thumb section, index finger section, middle finger section, ring finger section and baby finger section. The interior surface of the primary yarn defines the interior surface of the glove, and the exterior surface defines the exterior surface of the glove. A first plaiting yarn is plaited to portions of the exterior surface of the primary yarn, and a second plaiting yarn is plaited to the first plaiting yarn to form a plurality of enhanced sections formed on the exterior surface of the glove. The enhanced sections have at least one substantially enhanced physical characteristic in relation to the primary yarn.

According to another embodiment of the invention, the first plaiting yarn comprises a core strand of spandex, a first cover strand of polyester wrapped around the core strand, and a second strand of nylon wrapped around the first cover strand and the core strand.

According to another embodiment of the invention, a protective glove comprises a palm section, and a plurality of finger sections. A primary yarn defines the palm section, and finger sections, and has an interior surface defining the interior surface of the glove and an exterior surface defining the exterior surface of the glove. Spaced-apart enhanced sections are formed on the exterior surface of the glove and extend substantially laterally on at least one of the finger sections. Each enhanced section has at least one substantially enhanced physical characteristic in relation to the primary yarn.

According to another embodiment of the invention, the plurality of spaced apart enhanced sections comprise first and second ring sections extending around the circumference of at least one of the finger sections. The ring sections define a spaced interval therebetween.

According to another embodiment of the invention, the first ring section and the second ring section each have a width of about six millimeters and are spaced about three millimeters apart from each other.

According to another embodiment of the invention, the finger sections are comprised of a thumb section, an index finger section, a middle finger section, a ring finger section and a baby finger section. The spaced apart ring sections comprise at least two spaced apart ring sections extending around a circumference of the thumb section, and at least two spaced apart ring sections extending around a circumference of the index finger section.

According to another embodiment of the invention, the enhanced sections are formed by a secondary yarn plaited to selected portions of the exterior surface of the primary yarn.

According to another embodiment of the invention, the enhanced sections provide enhanced cut resistance, and the secondary yarn comprises ultra-high molecular weight polyethylene and/or a hard particle-filled polyethylene fiber, in which the hard particles have a MOHS hardness of greater than three.

According to another embodiment of the invention, the primary yarn comprises a core comprising a first strand of fiberglass and a second strand of ultra-high molecular weight polyethylene, and at least one cover strand wrapped around the core.

According to another embodiment of the invention, the cover strand comprises a first strand of textured polyester wrapped around the core, and a second strand of textured polyester wrapped around the core and the first strand of textured polyester.

DETAILED DESCRIPTION OF PREFERRED EMBODIMENTS AND BEST MODE

Figure 1:
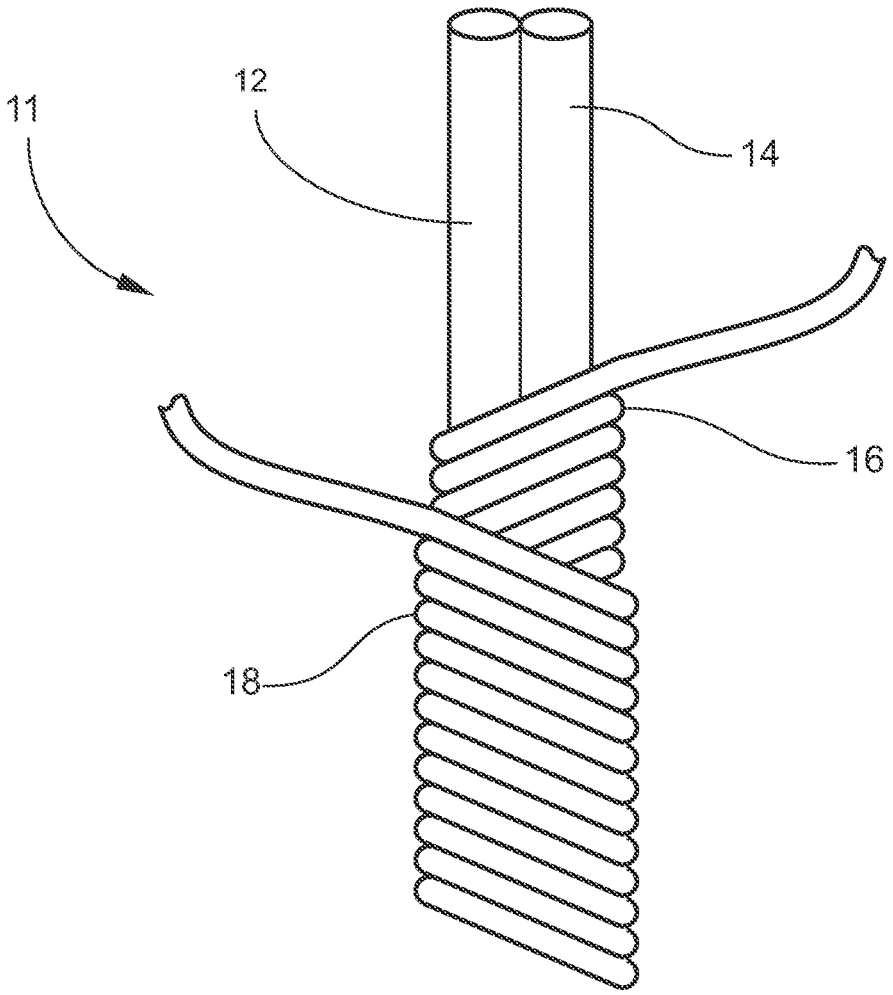
FIG. 1 is a schematic view of a yarn according to a preferred embodiment of the invention.

A protective glove according to a preferred embodiment of the invention is illustrated in FIGS. 1-6, and shown generally at reference numeral 10. The glove 10 is comprised of an inner primary yarn 11, and a plaiting yarn 21 having cut resistance properties plaited to the primary yarn 11. The inner primary yarn 11 can be comprised of a first core strand 12 of 450 (one hundred denier) fiberglass and a second core strand 14 comprised of four hundred denier ultra-high molecular weight polyethylene (UHMWPE), a first covering strand 16 of one-hundred fifty denier textured polyester wrapped around the core stands 12, 14, and a second covering strand 18 of one-hundred fifty denier textured polyester wrapped over the first cover strand 16, as shown in FIG. 1. As shown in FIG. 1, the first cover strand 16 is wrapped in an S orientation, while the second cover strand 18 is wrapped in a Z orientation. Alternatively, the first cover strand 16 can be wrapped in a Z orientation, and the second cover strand 18 can be wrapped in an S orientation.

Figure 5:
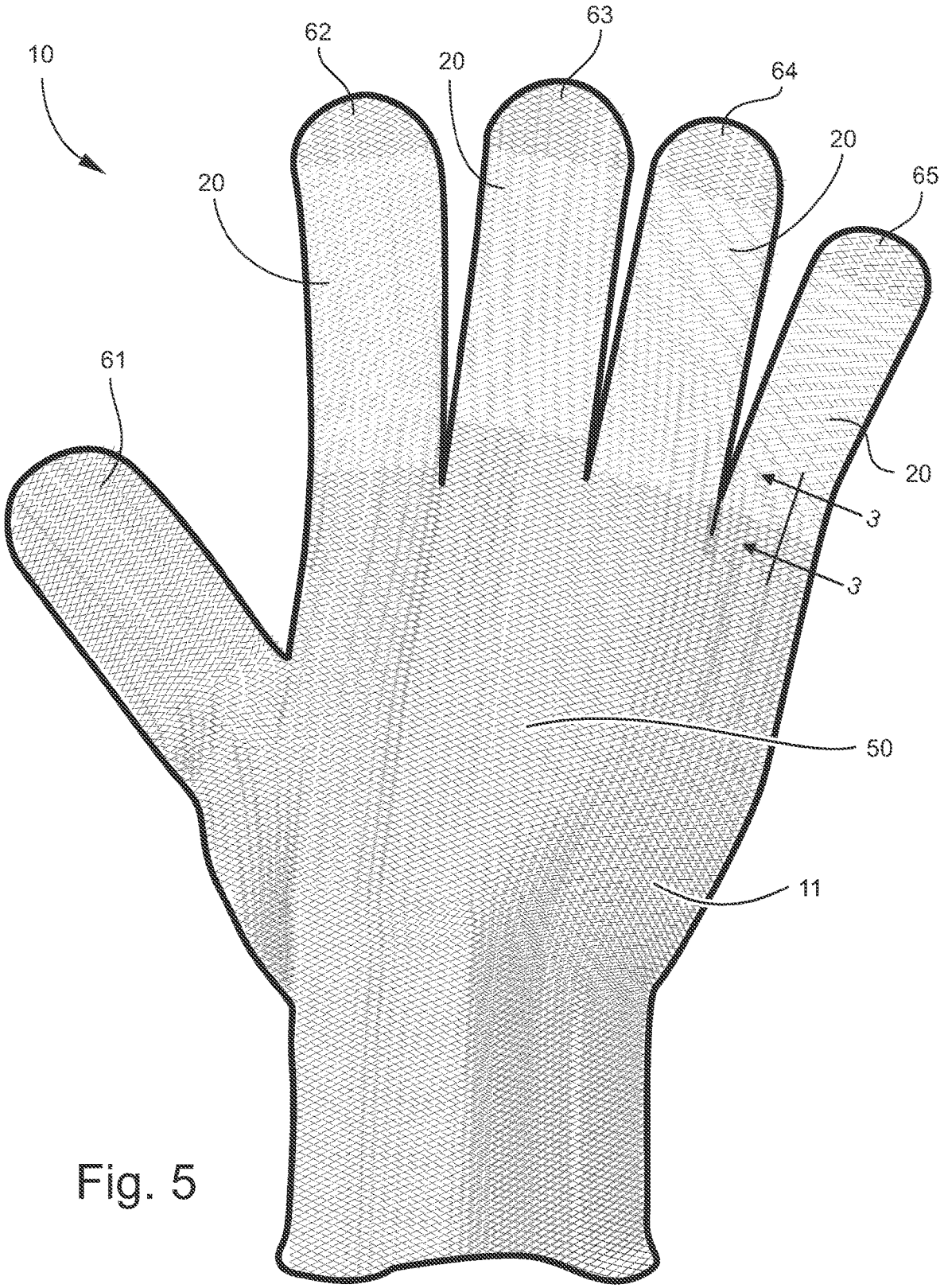
FIG. 5 is a schematic view of a protective glove according to a preferred embodiment of the invention.
Figure 6:
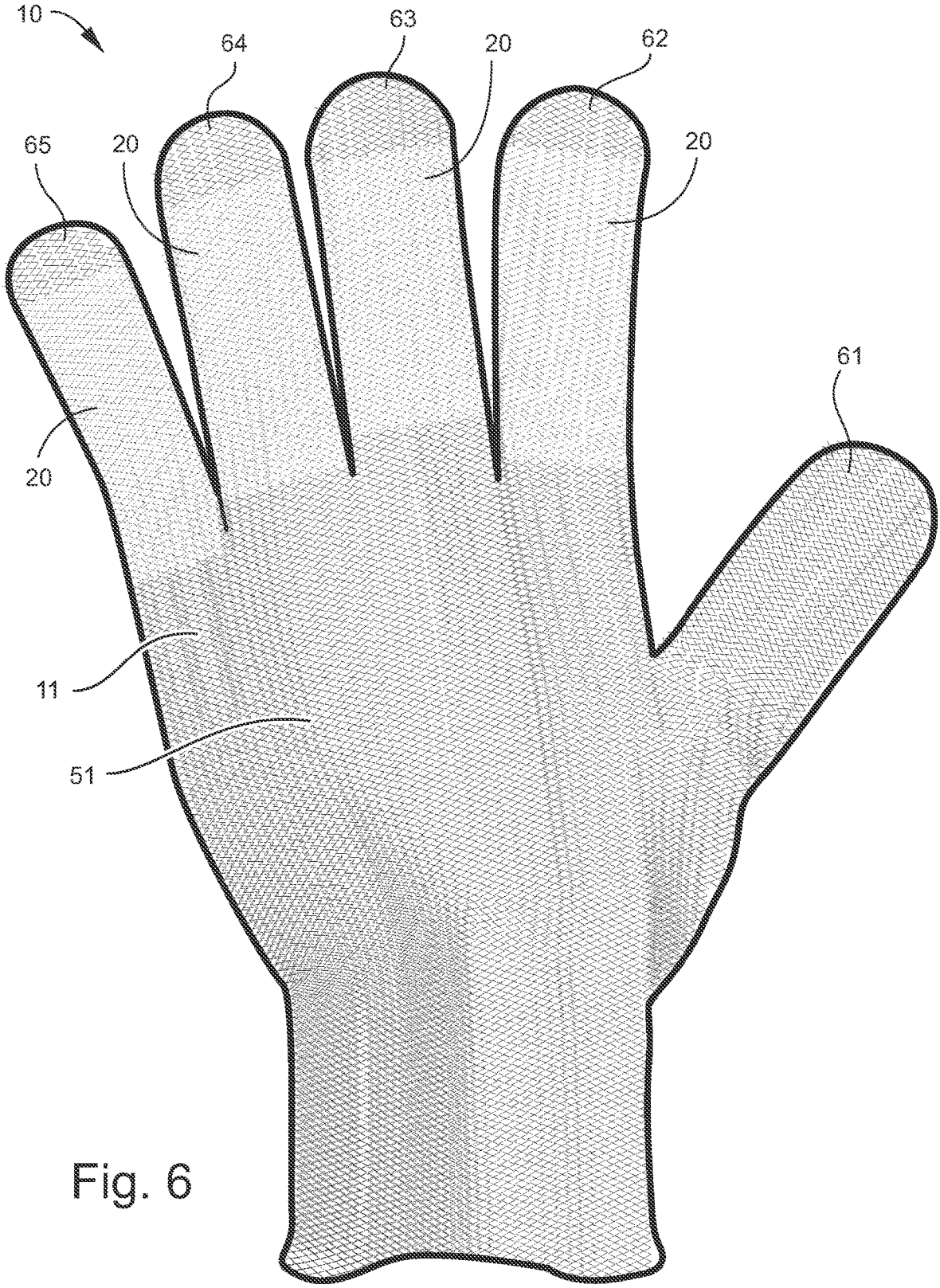
FIG. 6 is another schematic view of the protective glove of FIG. 5.

As shown in FIGS. 5 and 6, the glove 10 is generally comprised of a first palm section 50, a second palm section 51 on the opposite side of the first palm section 50, a thumb section 61, an index finger section 62, a middle finger section 63, a ring finger section 64 and a baby finger section 65, which are formed from the inner primary layer 11.

Figure 2:
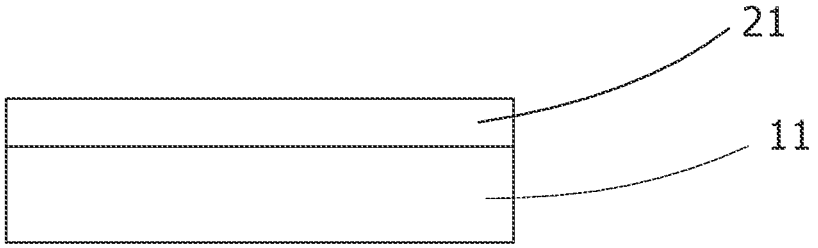
FIG. 2 is a magnified schematic view of a plaiting yarn plaited to a primary yarn according to a preferred embodiment of the invention.
Figure 7:
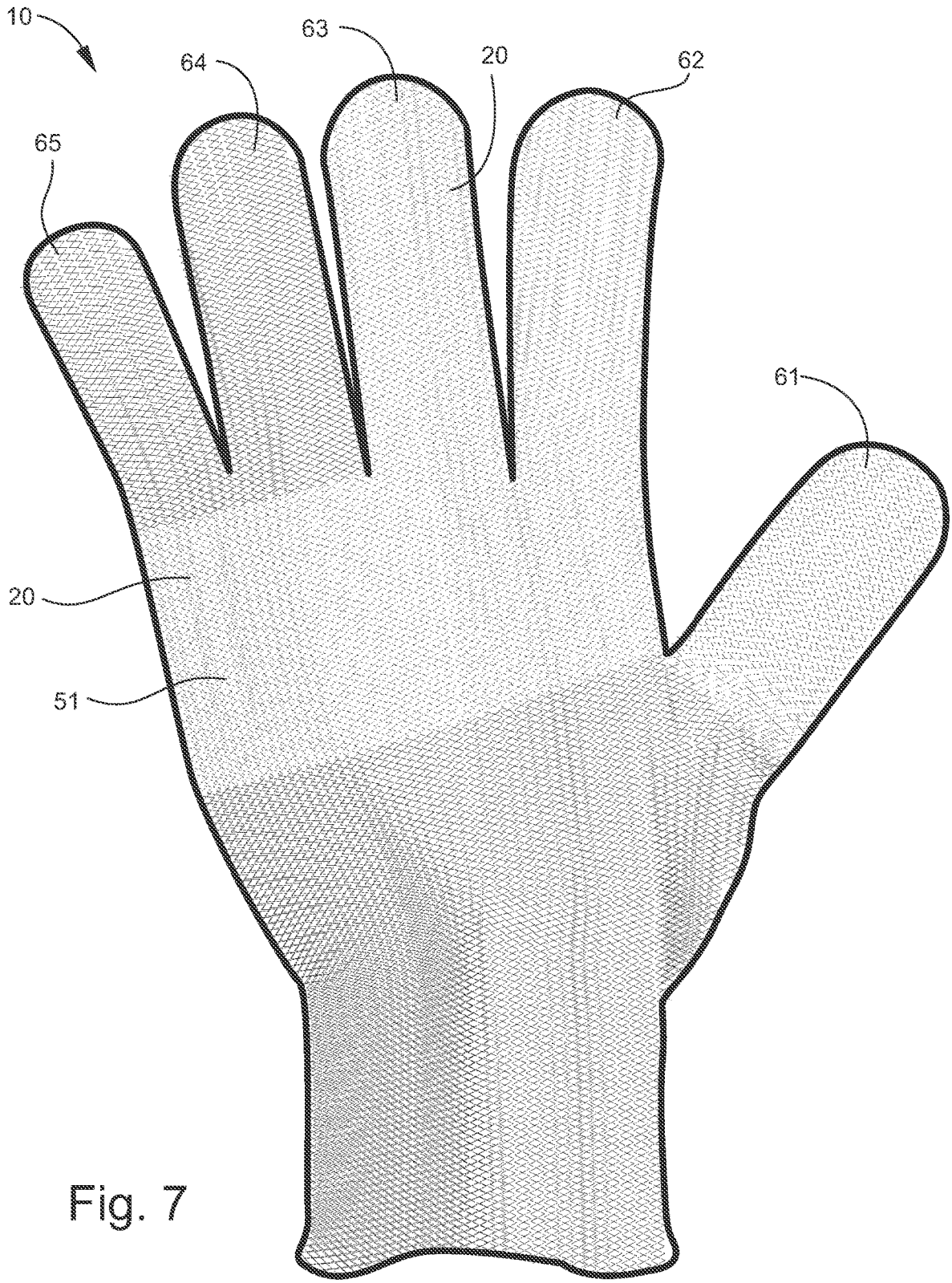
FIG. 7 is a schematic view of a protective glove according to another preferred embodiment of the invention.
Figure 8:
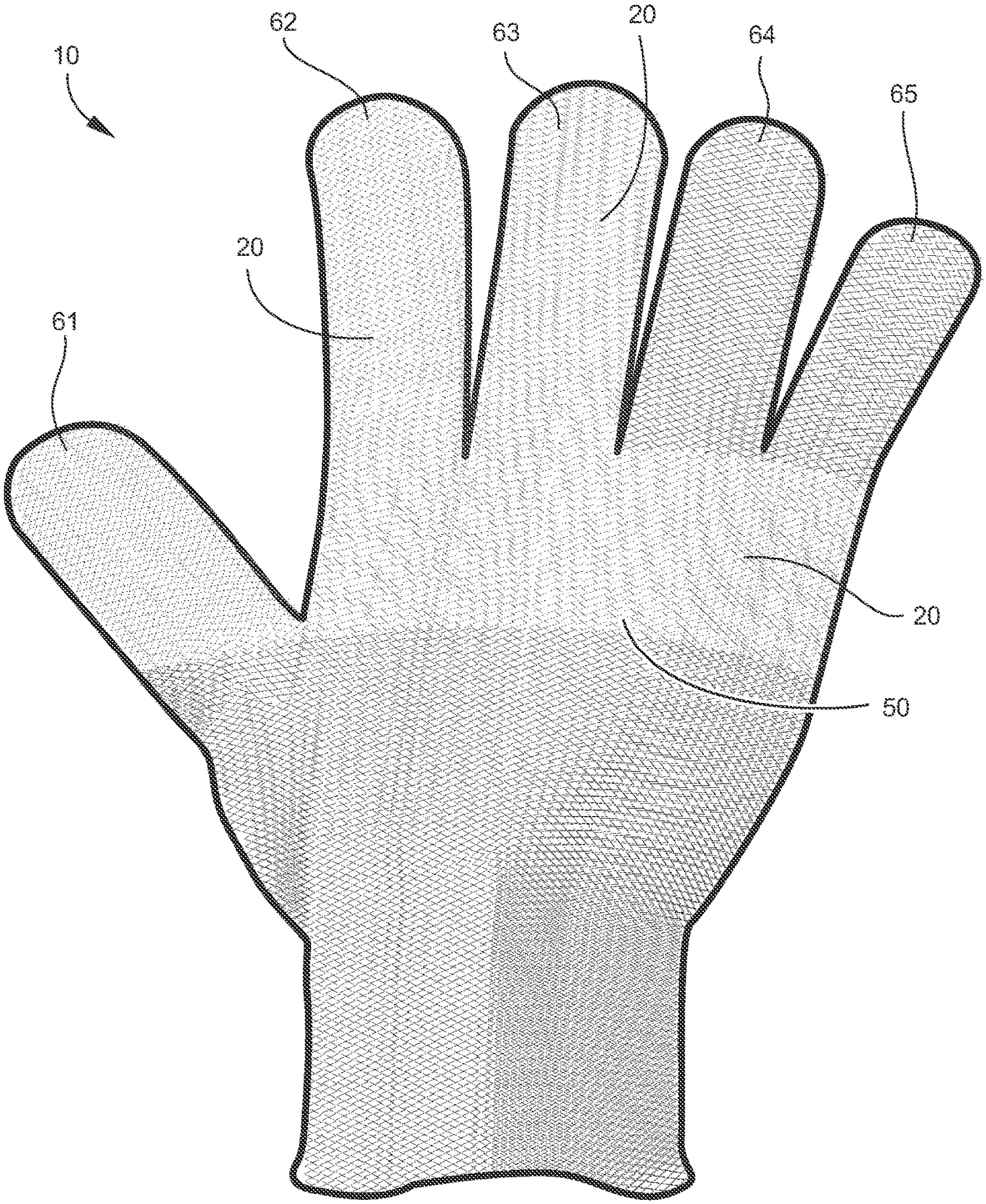
FIG. 8 is another schematic view of the protective glove of FIG. 7.

A plaiting yarn 21 comprising a strand of four hundred denier UHMWPE is plaited to the primary yarn 11, as shown in FIG. 2. The plaiting yarn 21 can be plaited at specific areas on the exterior surface of the inner primary layer 11 to form enhanced cut protection sections 20 on areas of the exterior of the glove 10 that are typically exposed to the greatest cutting hazard. As shown in FIGS. 5 and 6, the enhanced cut protection sections 20 can be formed on the index finger section 62, middle finger section 63, ring finger section 64 and baby finger section 65, except for at the fingertips. The enhanced sections 20 are formed on both sides of the glove 10 so that the glove is ambidextrous and can be worn on both the right and left hand. Alternatively, the enhanced sections 20 can be formed on the palm sections 50, 51, the thumb section 61, the index finger section 62, and the middle finger section 63, as shown in FIGS. 7 and 8. This configuration is particularly suitable for cut resistant gloves to be used in high hazard areas. By placing the enhanced sections 20 only at specific areas on the glove 10 where they are most needed, rather than plaiting the entire glove 10 with the plaiting yarn 21, the glove 10 can be made lighter in weight and more flexible.

The plaiting yarn 21 can be plaited to selected regions of the exterior surface of the primary yarn 11 using a conventional glove knitting machine modified to plate on the outside surface of the fabric in specified glove regions. By plaiting the plating yarn 21 directly to the exterior surface of the glove 10, it is not necessary to invert the glove 10 to have the plaiting yarn 21 on the outside of the glove, thereby eliminating this time consuming step from the manufacturing process.

Figure 3:
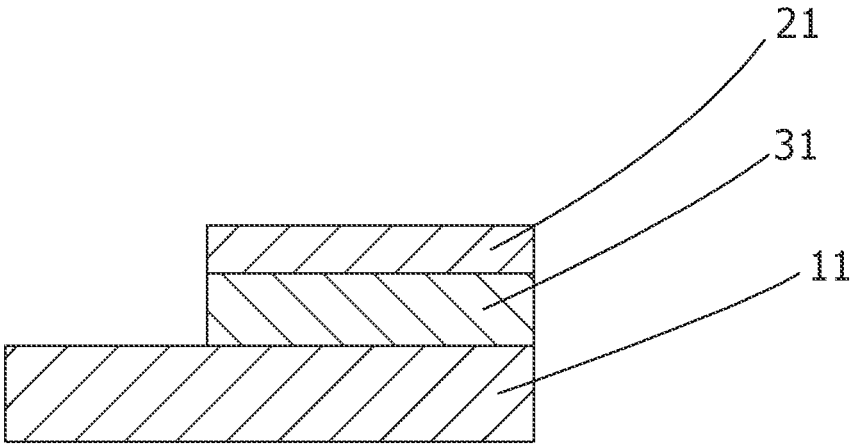
FIG. 3 is a cross sectional view taken along lines 3-3 of FIG. 5, showing a three layer fabric construction according to another preferred embodiment of the invention.
Figure 4:
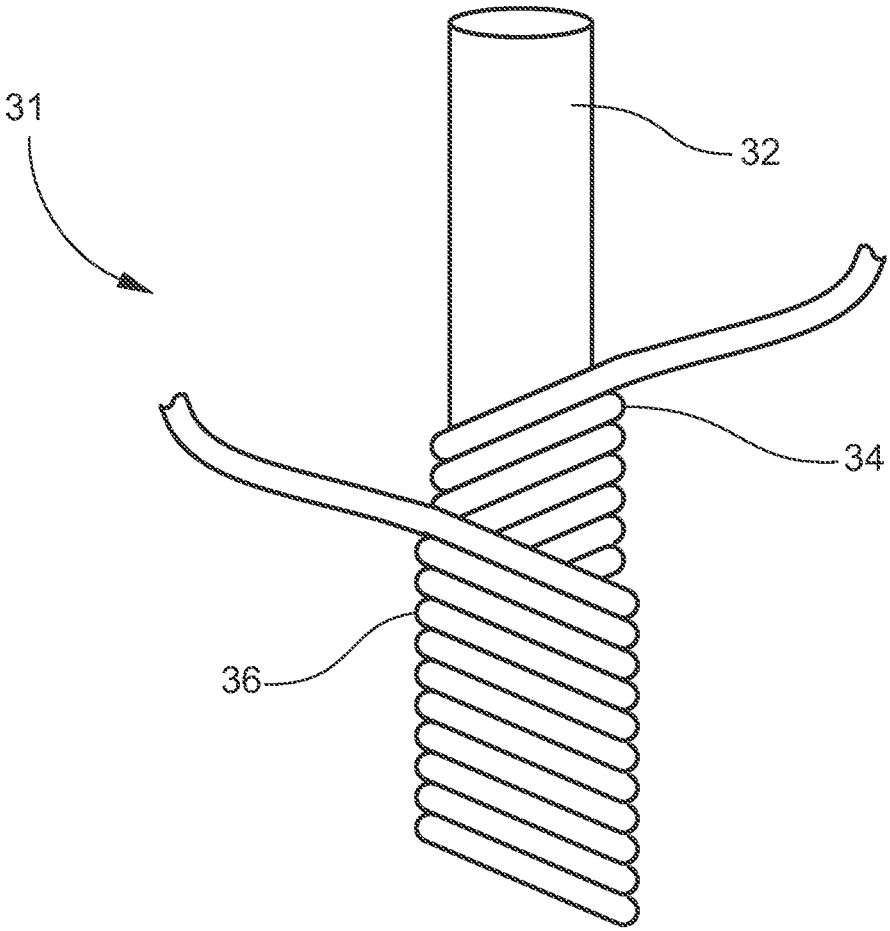
FIG. 4 is a schematic view of an intermediate plaiting yarn according to a preferred embodiment of the invention.

Alternatively, the protective glove 10 can be knit in three layers, utilizing two plaiting yarns 21, 31. As shown in FIG. 3, an intermediate plaiting yarn 31 comprised of spandex can be plaited to the inner primary yarn 11. The outer plaiting yarn 21, comprised of four hundred denier UHMWPE, is plaited to the intermediate plaiting yarn 31, as shown in FIG. 3. The intermediate plaiting yarn 31 can be comprised of a core strand 32 of forty denier spandex, a first covering strand 34 comprised of 20/1 polyester and a second covering strand 36 comprised of forty denier nylon, as shown in FIG. 4. The intermediate plaiting yarn 31 provides a softer, more elastic and form fitting feel of the glove 10. Alternatively, the intermediate plaiting yarn 31 can comprise a moisture wicking yarn, such as HYDROTECH, or a treated fiber such as STA-COOL or SORBTEK.

In an alternative embodiment, the inner primary yarn 11 first core strand 12 can be one hundred denier basalt fiber, the second core strand 14 can be two hundred denier UHMWPE, the first covering strand 16 can be seventy denier textured polyester and the second covering strand 18 can be seventy denier textured polyester. The plaiting yarn 21 can be a strand of four hundred denier hard particle-filled polyethylene fiber, in which the hard particles are polymeric or mineral particles having a MOHS hardness of greater than three.

In another alternative embodiment, the primary yarn 11 first core strand 12 can be D450 fiberglass, the second core strand 14 can be two hundred denier UHMWPE, the first covering strand 14 can be seventy denier textured polyester, and the second covering strand can be seventy denier polyester. The plaiting yarn 21 can comprise a two hundred denier hard particle-filled polyethylene fiber, in which the hard particles are polymeric or mineral particles having a MOHS hardness of greater than three.

In another alternative embodiment, two ends of the primary yarn 11 can be knit together through the same yarn feeder, and the plaiting yarn 21 is plaited thereto. The plaiting yarn 21 can comprise a strand of 20/1 aramid fiber, such as DuPont KEVLAR or Teijin TWARON, a strand of 0.0016 stainless steel, and a covering strand of 20/1 polyester wrapped around the aramid fiber and stainless steel.

In another preferred embodiment of the invention, the protective glove 10 has enhanced sections 20 having enhanced resistance to abrasion. In this embodiment, the glove 10 has an inner primary yarn 11 comprised of a first core strand 12 of D450 fiberglass, a second core strand 14 of two hundred denier UHMWPE, a first covering yarn 16 of seventy denier textured polyester, and a second covering yarn 18 of seventy denier textured polyester. The plaiting yarn 21 comprises a strand of two hundred twenty denier flat nylon, as shown in FIG. 3.

The plaiting yarn 21 can be plaited at specific areas on the inner primary layer 11 to form enhanced abrasion resistance sections 20 on the exterior of the glove 10, as shown in FIGS. 5 and 6. As shown in FIGS. 5 and 6, the enhanced abrasion resistance sections 20 can be formed on the index finger section 62, middle finger section 63, ring finger section 64 and baby finger section 65, except for at the finger tips. The enhanced abrasion resistance sections 20 are formed on both sides of the glove 10 so that the glove is ambidextrous and can be worn on both the right and left hand.

Alternatively, the glove 10 having enhanced abrasion resistance sections 20 can be knit in three layers, utilizing two plaiting yarns 21, 31. As shown in FIG. 3, an intermediate plaiting yarn 31 comprised of spandex can be plaited to the inner primary yarn 11. The outer plaiting yarn 21, comprised of two hundred twenty denier flat nylon, is plaited to the intermediate plaiting yarn 31. The intermediate plaiting yarn 31 can be comprised of a core strand 32 of forty denier spandex, a first covering strand 34 comprised of 20/1 polyester and a second covering strand 36 comprised of forty denier nylon, as shown in FIG. 4. Alternatively, the intermediate plaiting yarn 31 can comprise a moisture wicking yarn, such as HYDROTECH, or a treated fiber such as STA-COOL or SORBTEK.

In an alternative embodiment, the primary yarn 11 can be comprised of a first core strand 12 of one hundred fifty denier basalt fiber, a second core strand 14 of UHMWPE, with a first covering yarn of 70 denier textured polyester and a second covering yarn of 70 denier textured polyester. The plaiting yarn consists of a 20/1 polyester treated with PTFE.

In another alternative embodiment, the primary yarn 11 comprises a first core strand 12 of two hundred twenty denier flat polyester, a second core strand 14 of 0.002 stainless steel wire, a first covering strand 16 of 0.002 stainless steel wire, and a second covering strand of 3/150 denier textured polyester. The plaiting yarn 21 comprises two hundred twenty denier flat nylon.

According to another preferred embodiment of the invention, the protective glove 10 has enhanced sections 20 having improved gripping properties. The inner primary yarn 11 of this embodiment can be comprised of a first core strand 12 of D450 fiberglass, a second core strand 14 comprised of two hundred denier UHMWPE, a first covering yarn 16 comprised of seventy denier textured polyester, and a second covering yarn comprised of seventy denier textured polyester. The plaiting yarn 21 comprises a strand of fifty gauge latex rubber.

Figure 9:
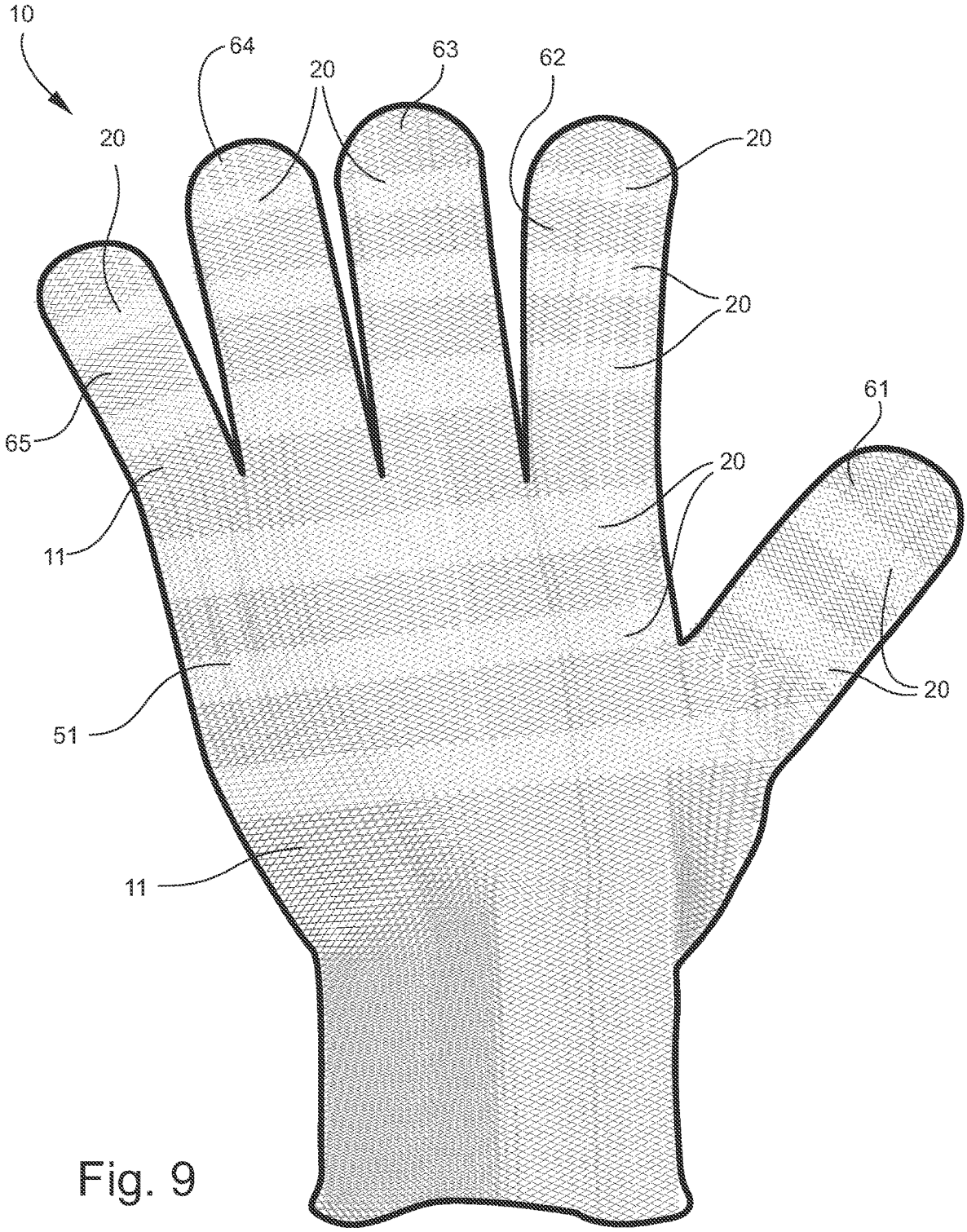
FIG. 9 is a schematic view of a protective glove according to another preferred embodiment of the invention.

The plaiting yarn 21 is plaited at specific areas on the inner primary layer 11 to form enhanced gripping sections 20 on the exterior of the glove 10. The enhanced sections 20 can be substantially rectangular sections extending laterally across the palm sections 50, 51, the thumb section 61, and the finger sections 62-65, as shown in FIG. 9. The enhanced gripping sections 20 are formed on both sides of the glove 10 so that the glove is ambidextrous and can be worn on both the right and left hand.

Alternatively, the glove 10 having enhanced gripping sections 20 can be knit in three layers, utilizing two plaiting yarns 21, 31. As shown in FIG. 3, an intermediate plaiting yarn 31 comprised of spandex can be plaited to the inner primary yarn 11. The outer plaiting yarn 21, comprised of fifty gauge latex rubber, is plaited to the intermediate plaiting yarn 31. The intermediate plaiting yarn 31 can be comprised of a core strand 32 of forty denier spandex, a first covering strand 34 comprised of 20/1 polyester and a second covering strand 36 comprised of forty denier nylon, as shown in FIG. 4. Alternatively, the intermediate plaiting yarn 31 can comprise a moisture wicking yarn, such as HYDROTECH, or a treated fiber such as STA-COOL or SORBTEK.

In an alternative embodiment, the primary yarn 11 is comprised of a first core strand 12 of two hundred twenty denier flat polyester, a second core strand 14 of 0.002 stainless steel wire, a first covering strand 16 of 0.002 stainless steel, and a second covering strand 18 of two hundred twenty denier textured polyester. The plaiting yarn 21 is comprised of a strand of four hundred twenty denier spandex.

In another alternative embodiment, the primary yarn 11 comprises a first core strand 12 of D225 fiberglass, a second core strand 14 of four hundred denier UHMWPE, a first covering strand 16 of one hundred fifty denier textured polyester, and a second covering strand 18 of fifty denier textured polyester. The plaiting yarn 21 is comprised of a strand of one hundred fifty denier micro-fiber polyester.

According to another preferred embodiment of the invention, the glove 10 can have enhanced exterior sections 20 that provide enhanced visibility of the glove 10. The protective glove 10 with enhanced visibility has an inner primary yarn 11 comprised of a first core strand of D450 fiberglass, a second core strand 14 of two hundred twenty denier UHMWPE, a first covering strand 16 comprised of 70 denier textured polyester, and a second covering strand comprised of 70 denier textured polyester. The plaiting yarn 21 comprises a retroreflective material such as the 2P2 Retroglo slit film sold by Metlon Corp.

Figure 10:
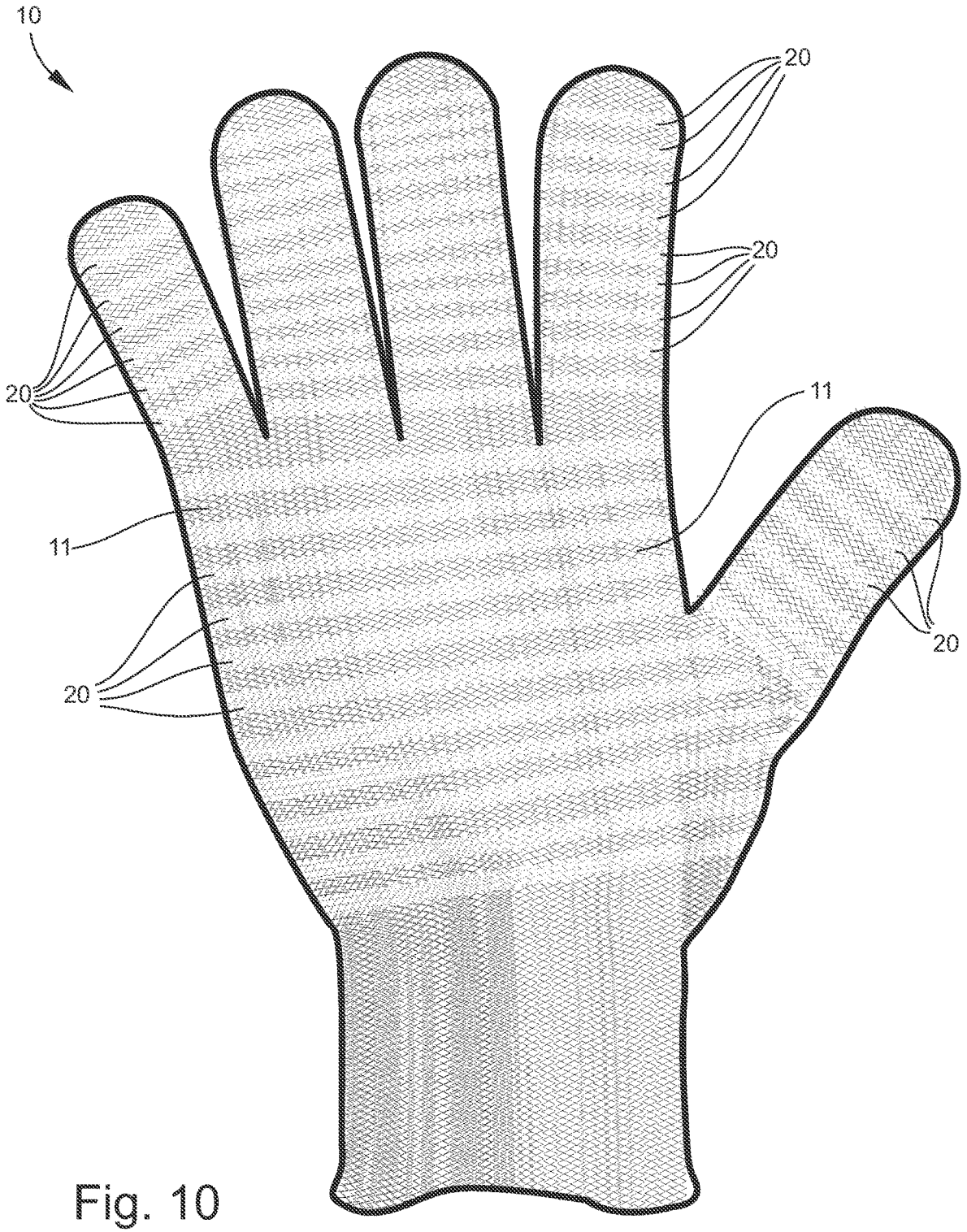
FIG. 10 is a schematic view of a protective glove according to another preferred embodiment of the invention.

The plaiting yarn 21 is plaited at specific areas on the inner primary layer 11 to form enhanced visibility sections 20 on the exterior of the glove 10. The enhanced visibility sections 20 can be substantially rectangular sections extending across the palm sections 50, 51, the thumb section 61, and the finger sections 62-65, as shown in FIG. 10. The enhanced visibility sections 20 are formed on both sides of the glove 10 so that the glove is ambidextrous and can be worn on both the right and left hand.

Alternatively, the glove 10 having enhanced visibility sections 20 can be knit in three layers, utilizing two plaiting yarns 21, 31. As shown in FIG. 5, an intermediate plaiting yarn 31 comprised of spandex can be plaited to the inner primary yarn 11. The outer plaiting yarn 21, comprised of a retro-reflective material, is plaited to the intermediate plaiting yarn 31. The intermediate plaiting yarn 31 can be comprised of a core strand 32 of forty denier spandex, a first covering strand 34 comprised of 20/1 polyester and a second covering strand 36 comprised of forty denier nylon, as shown in FIG. 6. Alternatively, the intermediate plaiting yarn 31 can comprise a moisture wicking yarn, such as HYDROTECH, or a treated fiber such as STA-COOL or SORBTEK.

According to another preferred embodiment of the invention, the glove 10 can have enhanced exterior sections 20 that are adapted for use on electronic touch screen devices. In this embodiment, the enhanced exterior sections 20 comprise electrically conductive materials enabling the wearer to operate a touch screen on an electronic device while wearing the glove 10 by contacting the touch screen with the enhanced sections 20. As such, the wearer may keep the glove 10 on his hand and use the touch screen device without having to remove the glove 10. This embodiment is particularly useful for those wearing cut resistant gloves in the workplace who need to manipulate electronic touch-screen devices for inventory, order processing communication and the like. The inner primary inner primary yarn 11 of this embodiment can be comprised of a first core strand 12 of D450 fiberglass, a second core strand 14 of two hundred twenty denier UHMWPE, a first covering strand 16 of seventy denier textured nylon, and a second covering strand 18 of seventy denier textured nylon. The plaiting yarn 21 can be comprised of a one hundred denier silver-coated electrically conductive yarn such as X-STATIC fiber sold by Noble Technologies.

Figure 11:
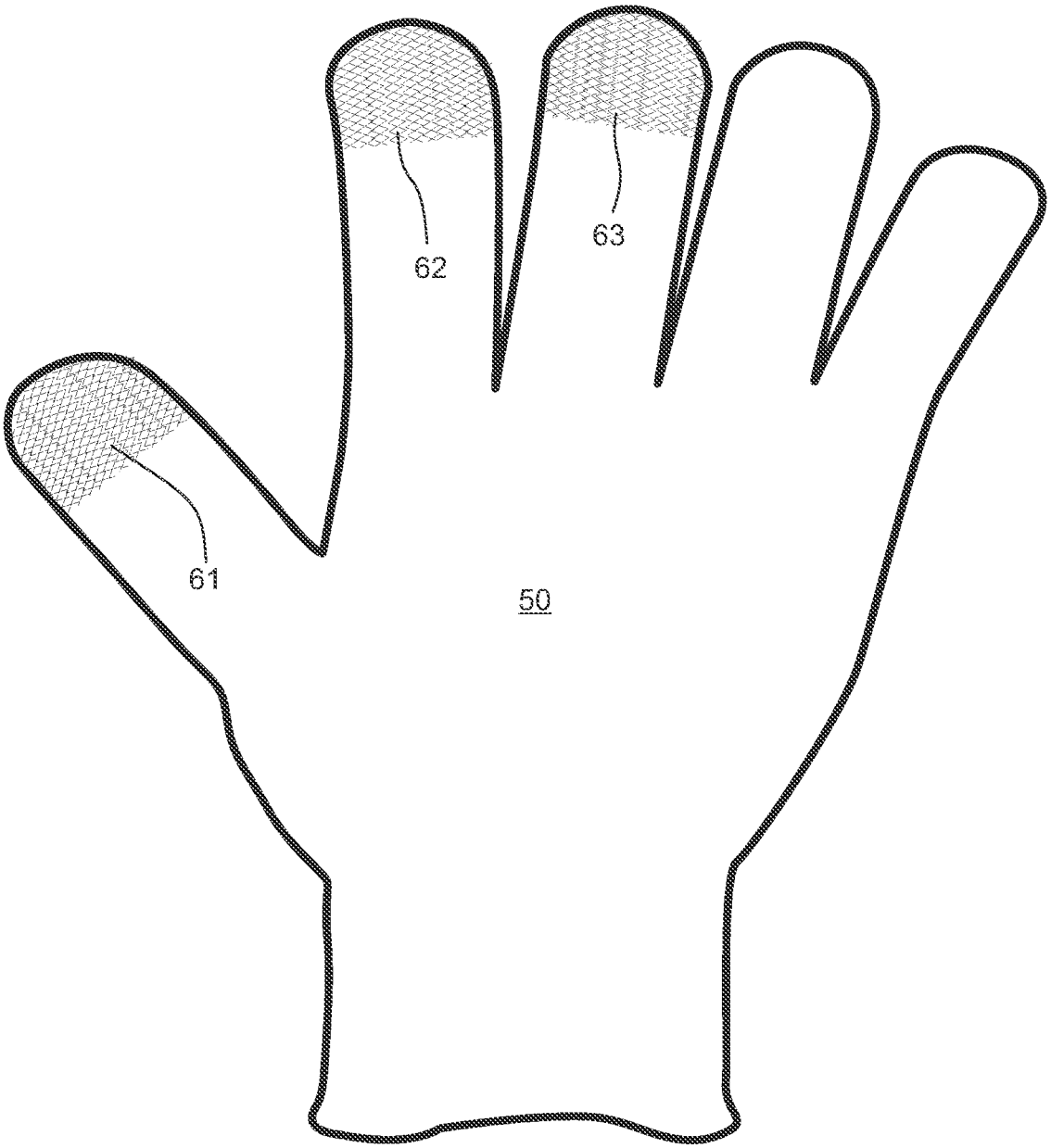
FIG. 11 is a schematic view of a protective glove according to another preferred embodiment of the invention.

The plaiting yarn 21 is plaited at specific areas on the inner primary layer 11 to form enhanced touch screen compatible sections 20 on the exterior of the glove 10. The enhanced touch screen compatible sections 20 can be located at the tips (distal phalanges) of the thumb 61, index finger 62 and middle finger 63, as shown in FIG. 11. The touch screen compatible sections 20 are formed on both sides of the thumb 61, index finger 62 and middle finger 63 so that the glove is ambidextrous and can be worn on either the right or left hand.

Alternatively, the glove 10 having touch screen compatible sections 20 can be knit in three layers, utilizing two plaiting yarns 21, 31. As shown in FIG. 5, an intermediate plaiting yarn 31 comprised of spandex can be plaited to the inner primary yarn 11. The outer plaiting yarn 21, comprised of an electrically conductive material, is plaited to the intermediate plaiting yarn 31. The intermediate plaiting yarn 31 can be comprised of a core strand 32 of forty denier spandex, a first covering strand 34 comprised of 20/1 polyester and a second covering strand 36 comprised of forty denier nylon, as shown in FIG. 6.

In an alternative embodiment, the primary yarn 11 can be comprised of a first core strand 12 of D225 fiberglass, a second core strand 14 of four hundred denier UHMWPE, a first covering strand 16 of one hundred fifty denier textured polyester, and a second covering strand 18 of one hundred fifty denier textured polyester. The plaiting yarn 21 can be comprised of a seventy denier electrically conductive copper-suffused nylon, such as THUNDERON fiber sold by Nihon Sanmo Dyeing Co.

Figure 12:
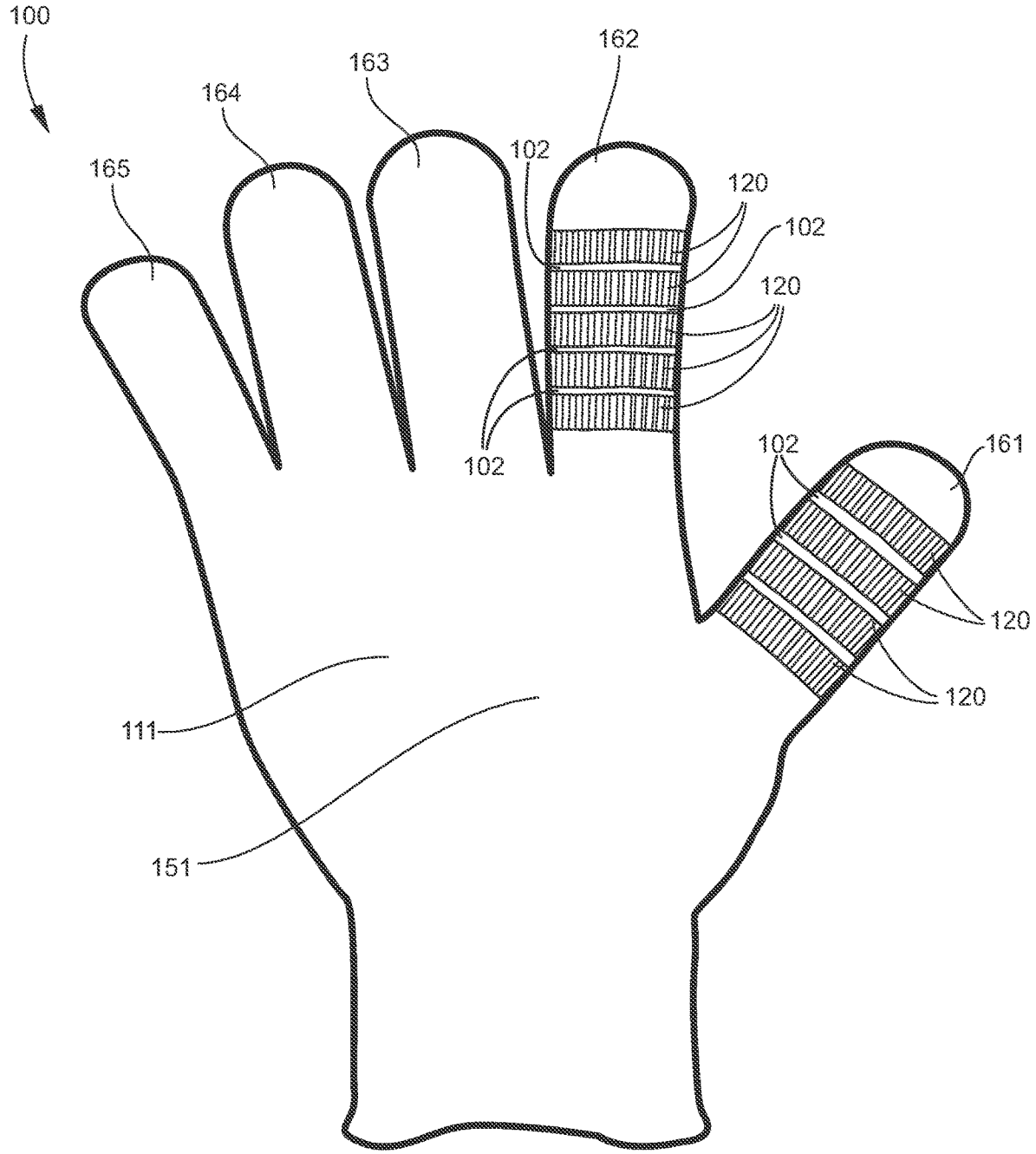
FIG. 12 is a schematic view of a protective glove according to another preferred embodiment of the invention.
Figure 13:
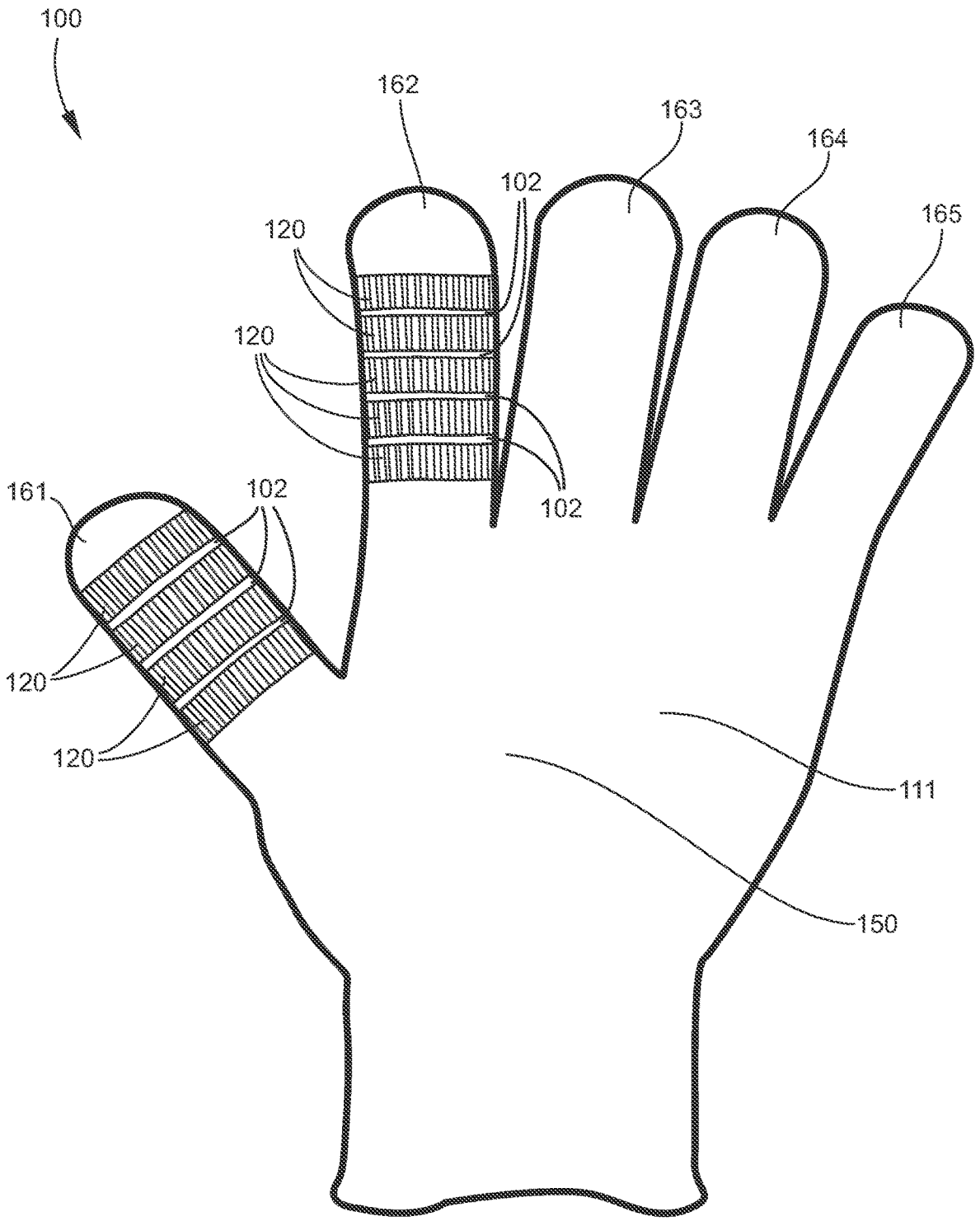
FIG. 13 is another schematic view of the protective glove of FIG. 12.

A protective glove according to another preferred embodiment of the invention is illustrated in FIGS. 12 and 13, and shown generally at reference numeral 100. The glove 100 is comprised of an inner primary yarn 111, and a plurality of spaced apart enhanced sections 120 formed on the exterior surface of the primary yarn 111. The enhanced sections 120 are positioned at closely spaced apart intervals 102. In between each enhanced section 120 is an interval 102 that has only the primary yarn 111. As such, the enhanced sections 120 have a staggered "hinge" like construction.

As shown in FIGS. 12 and 13, the glove 100 is generally comprised of a first palm section 150, a second palm section 151 on the opposite side of the first palm section 150, a thumb section 161, an index finger section 162, a middle finger section 163, a ring finger section 164 and a baby finger section 165, which are formed from the inner primary yarn 111.

The inner primary yarn 111 can have any one of the constructions of the primary yarns 11 of the embodiments previously described above. The enhanced sections 120 can be formed by plaiting a plaiting yarn at closely spaced apart areas on the exterior surface of the inner primary layer 111 using a computer driven jacquard machine. No plaiting yarn is plaited at the intervals 102 in between the enhanced sections 120. The plaiting yarn of the enhanced sections 120 can have any one of the construction of the plaiting yarns 21 of the embodiment previously described above. Alternatively, the enhanced sections 120 can be knit in three layers, utilizing two plaiting yarns, such as is described in reference to the previously described embodiments.

The enhanced sections 120 can be rectangular, and run substantially perpendicular to the length of the thumb section 161 and the index finger section 162, as shown in FIGS. 12 and 13. The enhanced sections 120 can extend laterally around the circumference of the thumb section 161 and the index finger section 162, as shown in FIGS. 12 and 13. In between each enhanced section 120 there is a spaced interval 102 in which there is only the primary yarn 111. Alternatively, there can be enhanced sections 120 on any one or more of the other finger sections 163, 164, 165. In yet another alternative embodiment, one or more enhanced sections 120 can extend around the palm sections 150, 151.

The enhanced sections 120 can provide enhanced cut resistance, enhanced abrasion resistance and/or enhanced gripping properties, depending on the plaiting yarn used to form the enhanced sections 120. In an embodiment in which the enhanced sections 120 are comprised of a plaiting yarn providing enhanced cut resistance and/or enhanced abrasion resistance, there can be five enhanced sections 120 extending around the circumference of the index finger section 162, and four enhanced sections 120 extending around the thumb section 161, as shown in FIGS. 12 and 13. This protects the wearer at the areas that are typically exposed to the greatest risk of a cutting hazard. Alternatively, the glove 100 can have a different number of enhanced sections 120, and the enhanced sections 120 can be positioned on additional finger sections 163, 164, 165.

The positioning of the enhanced sections 120 in closely spaced apart alignment with intervals 102 of no plaiting in between the enhanced sections 120 provide a hinge like construction, whereby the glove 100 can provide excellent flexibility, while providing enhanced cut resistance and/or abrasion resistance. This can be particularly important for the thumb section 161 and the index finger 162 section.

In a preferred embodiment, each enhanced section 120 can have a width of about six millimeters, and the spaced intervals 102 between each section 120 can be about three millimeters. The inner primary layer 111 can have a fabric thickness of about 1.0414 millimeters, and each enhanced section 120 can have a fabric thickness of about 1.270 millimeters.

Figure 14:
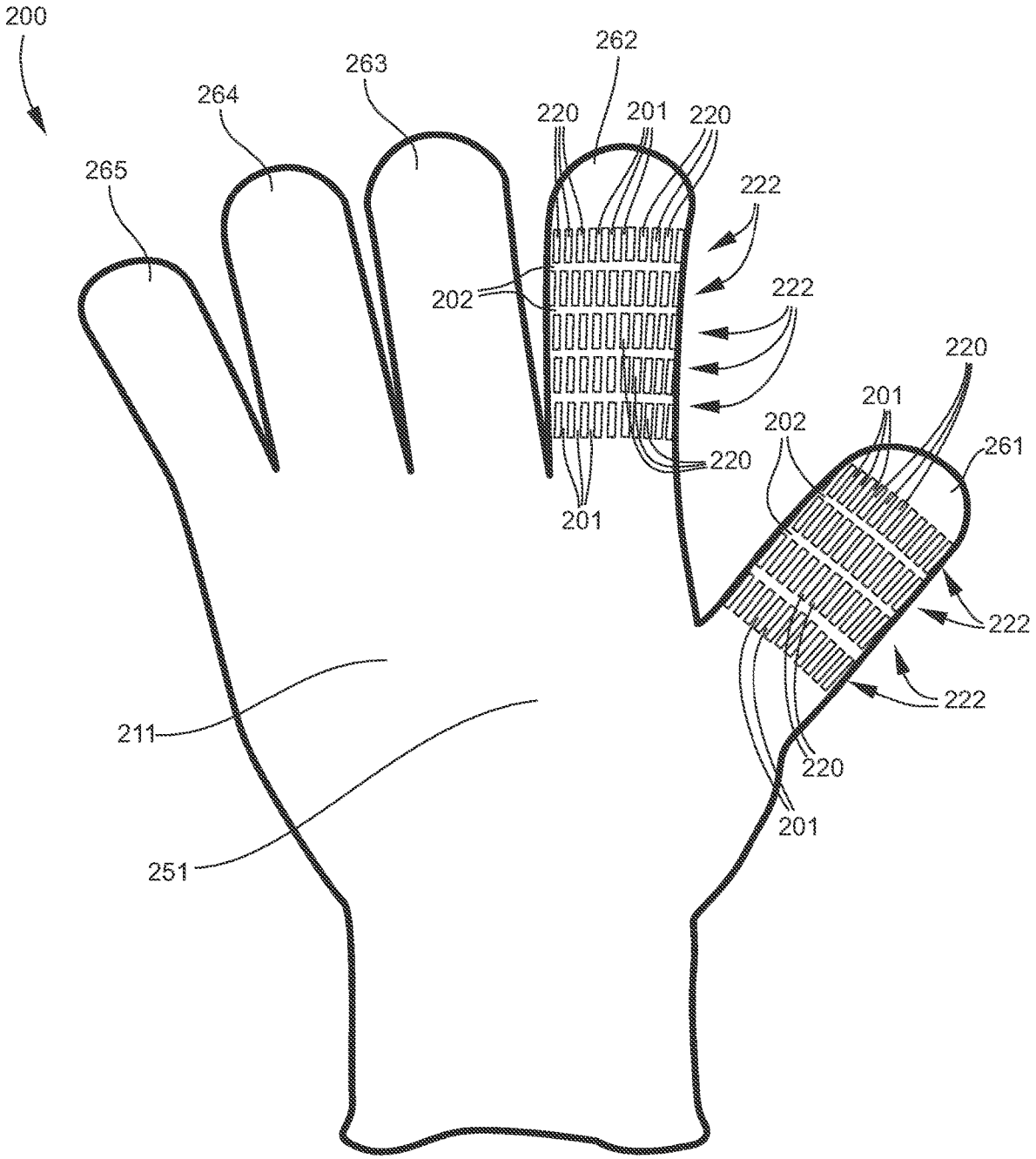
FIG. 14 is a schematic view of a protective glove according to another preferred embodiment of the invention.
Figure 15:
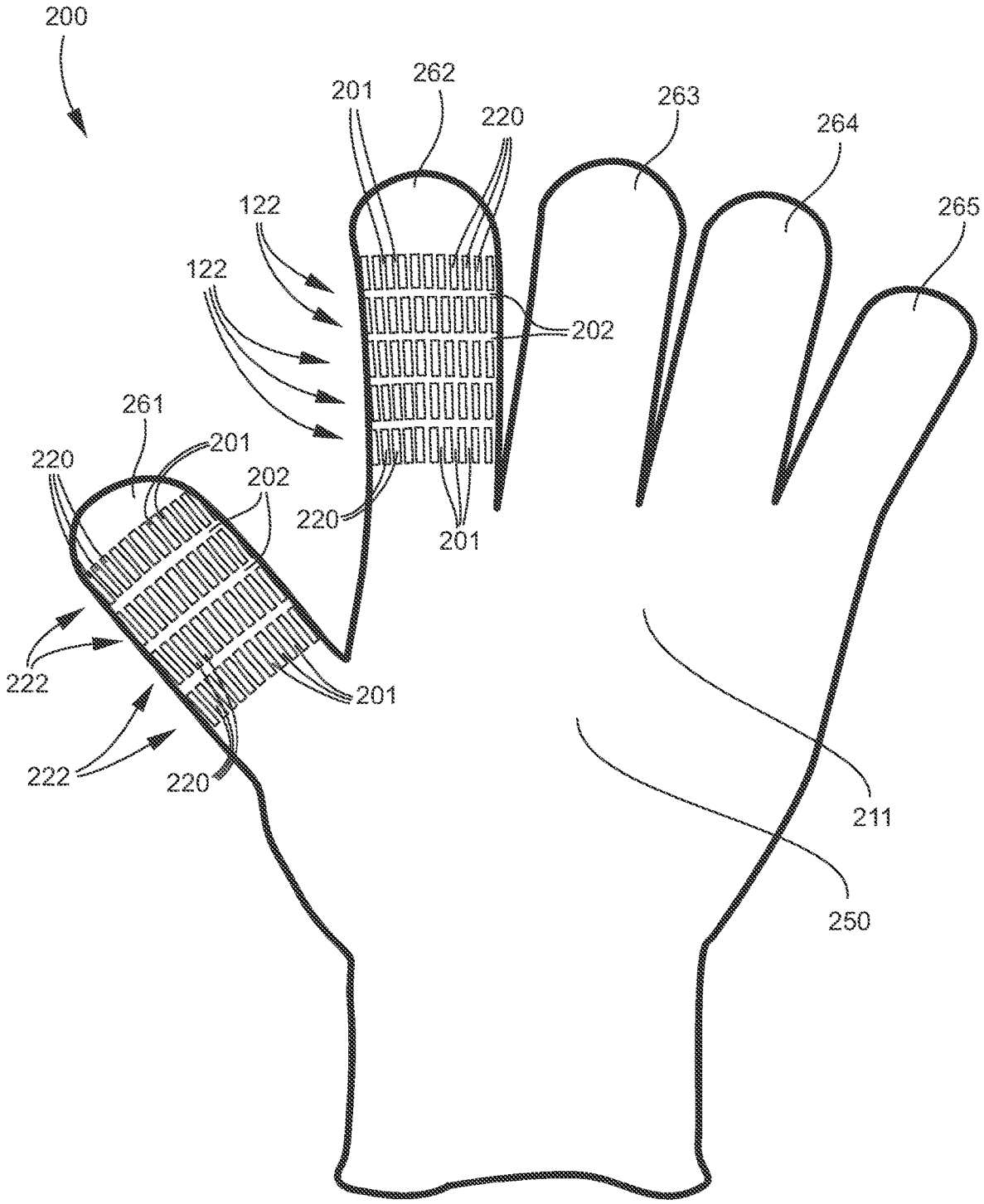
FIG. 15 is another schematic view of the protective glove of FIG. 14.

A protective glove according to another preferred embodiment of the invention is illustrated in FIGS. 14 and 15, and shown generally at reference numeral 200. The glove 200 is comprised of an inner primary yarn 211, and a plurality of relatively small, spaced apart enhanced sections 220 formed on the exterior surface of the primary yarn 211. The enhanced sections 220 are positioned at closely spaced apart intervals 201. The spaces 201 between the enhanced sections 220 are comprised of only the primary yarn 211. As such, the enhanced sections 120 have a staggered "speed bump" like construction.

As shown in FIGS. 14 and 15, the glove 200 is generally comprised of a first palm section 250, a second palm section 251 on the opposite side of the first palm section 250, a thumb section 261, an index finger section 262, a middle finger section 263, a ring finger section 264 and a baby finger section 265, which are formed from the inner primary yarn 211.

The inner primary yarn 211 can have any one of the constructions of the primary yarns 11 of the embodiments previously described above. The enhanced sections 220 can be formed by plaiting a plaiting yarn at closely spaced apart areas on the exterior surface of the inner primary layer 211. No plaiting yarn is plaited at the intervals 201 in between the enhanced sections 220. The plaiting yarn of the enhanced sections 220 can have any one of the construction of the plaiting yarns 21 of the embodiment 10 previously described above. Alternatively, the enhanced sections 220 can be knit in three layers, utilizing two plaiting yarns, such as is described in reference to the previously described embodiments.

The enhanced sections 220 can be rectangular, and extend longitudinally on the thumb section 261 and the index finger section 262. The enhanced sections 220 can be aligned to form a plurality of enhanced rings 222 extending laterally around the circumference of the thumb section 261 and the index finger section 262, as shown in FIGS. 14 and 15. In between each ring 222 there is a spaced interval 202 in which there is only the primary yarn 211 and no plaiting yarn. Alternatively, there can be enhanced rings 222 on any one or more of the other finger sections 263, 264, 265. In yet another alternative embodiment, one or more enhanced rings 222 can extend around the palm sections 250, 251.

The enhanced sections 220 can provide enhanced cut resistance, enhanced abrasion resistance and/or enhanced gripping properties, depending on the plaiting yarn used to form the enhanced sections 220. In an embodiment in which the enhanced sections 220 are comprised of a plaiting yarn providing enhanced cut resistance and/or enhanced abrasion resistance, there can be five enhanced rings 222 extending around the circumference of the index finger section 262, and four enhanced rings 222 extending around the thumb section 261, as shown in FIGS. 14 and 15. This is to protect the wearer at the areas that are typically exposed to the greatest risk of a cutting hazard. Alternatively, the glove 200 can have a different number of enhanced rings 222, and the enhanced rings 222 can be positioned on additional finger sections 263, 264, 265.

By positioning relatively small enhanced sections 220 in closely spaced apart alignment with spaced intervals 201, 202 comprised only the primary yarn 211 with no enhancing plaiting, the thumb section 261 and the index finger section 262 can have excellent cut resistance and/or abrasion resistance, while also having excellent flexibility. This can be particularly important for the thumb section 261 and the index finger 262 section.

In a preferred embodiment, each enhanced section 220 can have a length of about six millimeters and a width of about two millimeters. The spaced intervals 101 measured between the lateral sides of each enhanced section 220 can be about one millimeter, and the space 202 between each ring 222 (the distance between longitudinal ends of enhanced sections 220 in adjacent rings 222) can be about three millimeters. The inner primary layer 211 can have a fabric thickness of about 1.0414 millimeters, and each enhanced section 220 can have a fabric thickness of about 1.270 millimeters.

Protective gloves and methods of making same are described above. Various changes can be made to the invention without departing from its scope. The above description of embodiments and best mode of the invention are provided for the purpose of illustration only and not limitation—the invention being defined by the claims and equivalents thereof.

What is claimed is:

1. A protective glove comprising:

(a) a primary yarn defining a palm section, thumb section, index finger section, middle finger section, ring finger section and baby finger section, the primary yarn having an interior surface defining an interior surface of the glove and an exterior surface defining an exterior surface of the glove, wherein the primary yarn comprises a core comprising a first core strand of fiberglass and a second core strand of ultra-high molecular weight polyethylene extending parallel to the first core strand, and a cover comprising at least one cover strand wrapped around the core; and (b) a first plaiting yarn comprising spandex plaited to portions of the exterior surface of the primary yarn and a second plaiting yarn comprising a hard particle-filled polyethylene fiber wherein the hard particles have a MOHS hardness of greater than three plaited to the first plaiting yarn to form a plurality of enhanced sections formed on the exterior surface of the glove, the plurality of enhanced sections having enhanced cut resistance in relation to the primary yarn.

2. The glove according to claim 1, wherein the enhanced sections comprise a plurality of spaced apart ring sections extending substantially laterally on at least one of the thumb section, index finger section, middle finger section, ring finger section and baby finger section of the glove.

3. The glove according to claim 2, wherein the plurality of spaced apart ring sections comprise first and second ring sections extending around a circumference of at least one of the thumb section, index finger section, middle finger section, ring finger section and baby finger section of the glove, and defining a spaced interval therebetween.

4. The glove according to claim 3, wherein the plurality of spaced apart ring sections comprise at least two spaced apart ring sections extending around a circumference of the thumb section, and at least two spaced apart ring sections extending around a circumference of the index finger section.

5. The glove according to claim 1, wherein the at least one cover strand of the primary yarn comprises polyester.

6. The glove according to claim 1, wherein the enhanced sections are formed only on the palm section, the thumb section, the index finger section, and the middle finger section.

7. The glove according to claim 1, wherein the core of the primary yarn further comprises a third core strand comprised of stainless steel wire.

* * * * *